United States Patent [19]

Richardson

[11] Patent Number: 4,646,832

[45] Date of Patent: Mar. 3, 1987

[54] DETERMINING RESIDUAL OIL SATURATION BY INJECTING SALTS OF CARBONIC AND HALOCARBOXYLIC ACIDS

[75] Inventor: Edwin A. Richardson, Houston, Tex.

[73] Assignee: Shell Oil Company, Houston, Tex.

[21] Appl. No.: 800,849

[22] Filed: Nov. 22, 1985

[51] Int. Cl.[4] ..... E21B 43/22; E21B 47/00

[52] U.S. Cl. ..... 166/250; 166/300; 436/28; 436/29

[58] Field of Search ..... 166/250, 252, 300, 270; 73/155; 436/27, 28, 29

[56] References Cited

U.S. PATENT DOCUMENTS

| | | | |
|---|---|---|---|
| 2,868,625 | 1/1959 | Frank | 73/155 X |
| 3,367,417 | 2/1968 | McCabe | 166/250 |
| 3,623,842 | 11/1971 | Deans | 166/252 X |
| 3,751,226 | 8/1973 | Hesse et al. | 436/27 |
| 3,856,468 | 12/1974 | Keller | 166/252 X |
| 3,990,298 | 11/1976 | Deans | 166/252 X |
| 4,122,896 | 10/1978 | Scheuerman et al. | 166/250 |
| 4,303,411 | 12/1981 | Chen et al. | 166/252 X |
| 4,523,642 | 6/1985 | Venkatesan | 166/300 |

*Primary Examiner*—George A. Suchfield

[57] ABSTRACT

Residual oil saturation is determined by injecting water containing or contacting dissolved halocarboxylic acid salt and carbonate salt into an oil and water containing reservoir and chromatographically analyzing the patterns of the concentrations of in situ generated $CO_2$ and water soluble acid salt in fluid produced from the reservoir.

4 Claims, No Drawings

DETERMINING RESIDUAL OIL SATURATION BY INJECTING SALTS OF CARBONIC AND HALOCARBOXYLIC ACIDS

RELATED APPLICATION

This application is related to my commonly assigned and concurrently filed patent application Ser. No. 800,852 relating to determining residual oil saturation by injecting $CO_2$ and base generating reactant. The disclosures of that application are incorporated herein by reference.

BACKGROUND OF THE INVENTION

This invention relates to determining the relative concentrations of fluids within subterranean reservoirs by measuring the chromatographic separation of tracers having distinctly different partitioning coefficients in mobile and immobile phases, such as water and oil phases, of fluids within the reservoirs. More particularly, the present invention relates to improving a process for making such determinations by injecting an aqueous solution of reactants arranged to form $CO_2$ which is significantly partitioned between such mobile and immobile phases while maintaining an unchanging concentration of acid anions dissolved in the mobile phase.

A method for determining the relative amounts of mobile and immobile fluid phases within a subterranean reservoir by injecting carrier fluid containing a reactant capable of forming within the formation at least two tracers which have different partitioning coefficients between the carrier fluid and the immobile fluid phase, as exemplified by the tracers formed by a hydrolyzable organic ester, and measuring the separation of the tracers, was described in 1969 in U.S. Pat. No. 3,623,842. U.S. Pat. No. 3,751,226 by R. J. Hesse and R. F. Farmer relates to improving such a process by injecting a solution in which the tracer forming reactant is a hydrolyzable beta-keto ester such as ethylacetolacetate. U.S. Pat. No. 3,847,548 relates to improving such a process by injecting carrier fluid containing tracers which partition differently in respect to temperature changes and injecting that fluid a temperature different from the reservoir temperature. U.S. Pat. No. 3,856,468 relates to improving such a process by injecting carrier fluid containing both a precursor which forms a tracer material that partitions between the fluid phases and a tracer material which is inert and substantially completely dissolved in the mobile phase. U.S. Pat. No. 3,990,298 relates to improving such a process by injecting a carrier fluid containing a plurality of precursors each of which forms a tracer which has a distinctive partition coefficient with at least one mobile fluid phase within the reservoir. U.S. Pat. Nos. 4,099,565 and 4,168,746 relate to uses of such a fluid saturation determining process for evaluating the effectiveness of a design process for recovering oil.

U.S. Pat. No. 4,122,896 by R. F. Scheuermann, E. A. Richardson and C. C. Templeton relates to acidizing a reservoir by injecting an aqueous solution of halocarboxylic acid salt so that the rate of the acidization is limited to the rate of it hydrolysis. The disclosures relating to the hydrolysis of halocarboxylic acids contained in that patent are incorporated herein by reference.

SUMMARY OF THE INVENTION

The present invention relates to improving a process in which a reactant-containing aqueous solution is injected into a subterranean reservoir for reacting in situ, in order to form tracers having different partition coefficients relative to mobile water and immobile oil fluid phases within the reservoir, and the chromatographic separation of the tracers are utilized for determining the relative saturations of the fluid phases. The improvement is effected by injecting as a tracer-forming solution an aqueous solution which, at least soon after entering the reservoir formation, contains salts of both a carbonic acid and a halocarboxylic acid. Those salts react within the reservoir to form tracers comprising $CO_2$ (which is significantly partitioned between mobile and immobile fluid phases such as oil and water phases) and a salt of a hydroxycarboxylic acid (which is substantially completely dissolved within the mobile phase of the fluid in the reservoir).

DESCRIPTION OF THE INVENTION

It appears that, in conventional testing operations, the only tracer-forming reactants which have heretofore been successfully used have been hydrolyzable lower alkyl carboxylic acid esters such as those described in U.S. Pat. No. 3,623,842, or the analogous betaketoalkyl carboxylic acid esters capable of providing an unreacted ester or ketone as the tracer which is partitioning between the water and oil (or other mobile and immobile phases) and a tracer such as alcohol (or inert material) which is substantially completely dissolved in the water phase. Such prior processes have received wide industry acceptance as a "single well tracer method" and more than a hundred jobs have been done. But, in general, the dependance upon organic esters has limited the use of the method to reservoirs having relatively low temperatures.

COMPARISON OF TRACER CAPABILITIES

(1) Temperature Range

In typical prior processes an organic ester which is partially soluble in oil serves as the oil phase tracer which is injected at the wellbore and displaced to the desired distance from the wellbore by an inert fluid. A soak period then allows time for a hydrolysis reaction to take place and produce a significant amount of alcohol. The alcohol is not soluble in the oil and thus serves as the water phase tracer.

The hydrolyses step must not be too fast since it is undesirable for the alcohol to be produced during the placement step and also, some unreacted ester must remain after the soak period as it is the oil phase tracer. At the end of the soak period, both tracers are produced back to the wellbore. The amount of chromatographic separation of the two tracers is measured and used to calculate residual oil saturation.

If the reservoir temperature is above about 200° F., the hydrolysis rate of most, if not all, known esters is so fast that the above requirements cannot be met. Therefore, the prior processes have been limited to reservoirs of about 200° F. or less.

The present process removes this limitation by using different tracers and different means of in situ generation. In the present process, the oil phase tracer is $CO_2$. It is generated in situ during the soak period. The acid anion concentration does not change during the above reactions and serves as the water phase tracer. Where the reactants comprise sodium chloroacetate and sodium bicarbonate the reactions can be summarized as follows:

$$ClCH_2COONa + H_2O \rightarrow HOCH_2COOH + NaCl$$

$$HOCH_2COOH + NaHCO_3 \rightarrow HOCH_2COONa + CO_2 + H_2O$$

A very large number of choices are available for selection of the halocarboxylic acid. Examples of such acids are given in Table I along with a best estimate of the applicable temperature range for each listed $CO_2$ generator:

TABLE I

| $CO_2$ Generator | Temperature Range, °F. |
|---|---|
| (1) 3-Chlorobutyric acid salt | 80 to 110 |
| (2) 3-Chloropropionic acid salt | 100 to 130 |
| (3) 2-Chloropropionic acid salt | 120 to 150 |
| (4) Mono Bromo Acetic acid salt | 140 to 170 |
| (5) Mono Chloro Acetic acid salt | 160 to 220 |
| (6) DiChloro Acetic acid salt | 180 to 250 |
| (7) Ortho Chlorobenzoic acid salt | >300 |

(2) Deeper Penetration (depth of investigation) from the Wellbore

In typical prior processes the oil phase tracer is an ester (i.e., ethylacetate) which is injected within a carrier fluid. This ester partitions between the oil and the water of the carrier fluid. The effect is to retard the advance of the ester front into the reservoir. In most cases the ester will reach a distance corresponding to a volume of only about one-third that of the volume of the total fluid injected.

The present method avoids this problem because the oil phase tracer ($CO_2$) is not present in the fluids being pumped (except in unavoidable minor amounts). The $CO_2$ forms mainly after the placement is complete. Thus, $CO_2$ is generated at the leading edge and throughout the solution injected and hence is about 3 times (by volume) further from the wellbore than the ester system, when the production part of the cycle starts.

Thus, the $CO_2$ oil phase tracer of the present system will penetrate further into the formation than an ester system tracer (for a given volume of treatment) and will provide a residual oil measurement over about 3 times the volume of reservoir sampled by the prior system.

(3) Distribution Coefficient

The distribution coefficient, Ki, (ratio of concentration of tracer in the oil phase to that in the water phase) of esters is about 6 in most cases. Ki for $CO_2$ is about 2.

The $CO_2$ value for Ki is much more optimum from a test sensitivity point of view in most cases, since more of it is present in the water phase, which comprises the substantially all of the produced fluid.

Also, the $CO_2$ tracer will be produced back to the wellbore much sooner than an equivalent ester tracer would be.

If this property is combined with the smaller volumes needed for sampling the reservoir because of deeper penetrating capability of the $CO_2$ tracer, only small jobs with $CO_2$ tracer may be necessary. In this case, several small $CO_2$ tests could be run on different wells instead of the one large ester test currently practiced. This would give better overall reservoir values for Sor (residual oil saturation than is currently possible.

(4) Drift During Soak Period

In most reservoirs, fluid injected into a well will drift with the overall reservoir fluids when the pumps are shut down. This may be as much as a few feet per day.

In the ester system, long soak periods are frequently required. This makes drift important as a source of error for which corrections must be made. Also, considerable accuracy and sensitivity is lost in the process.

In the present process, the wide choice of acid generators which react at different rates at different temperatures coupled with more rapid backflow will greatly diminish the effect of drift in many cases. This is because acid generators can be more optimally selected to correspond to the actual reservoir temperature involved. Also, the water tracer and oil tracer will stay much closer together in the reservoir and hence cancel much of the errors introduced by the reservoir drift velocity.

(5) Hydrolysis Rate vs pH

The hydrolysis rate for most substances is affected by pH. Esters have a rate constant which varies by about a factor of 10 for each 1 unit change in pH (i.e., the rate is proportional to the OH ion concentration). This proportionality means that the hydrolysis rate of an ester slows down as the pH drops due to the acid generated thereby. This means that difficulties can occur in getting enough alcohol to form in the reservoir so that enough water tracer will be available for analysis.

(6) Spending of $CO_2$ Generators

Since it is the concentration of the anions of the $CO_2$ generator molecules which are used as the water phase tracer, their hydrolysis and resultant release of $CO_2$ involves no change in the number of the anions. Thus, the concentration of the water tracer remains constant, regardless of the rate or extent of the hydrolysis reaction.

(7) Stripping of Light Hydrocarbons from the Oil Phase

The injection of brine from surface locations results in dissolving light hydrocarbons such as methane and ethane from the residual oil first contacted in the reservoir.

In the prior unreacted ester tracer system, this "stripped" oil is the oil which is "immobile" during the chromatic production operation. During the injection the injected water front travels much faster than the ester front and, it is unlikely (1) that the light ends thus "stripped" from the oil will be recombined with the oil as the water and ester are produced back to the wellbore and (2) that this will occur before the ester again contacts that oil.

In the present $CO_2$ system, a similar stripping on injection will occur. But, the production cycle is such that considerable native reservoir water will have flowed past any stripped oil before any $CO_2$ can contact the stripped oil. Of course, the $CO_2$ has not previously contacted this oil in contrast to the ester system.

(8) Miscellaneous (a) More precise positioning of $CO_2$ in the reservoir may make it possible to use frontal analysis techniques on the tracers instead of band analyses used for the esters. Frontal analyses should be more accurate.

(b) In some cases, very small amounts of $CO_2$ may be sufficient due to the high sensitivity and stability of the analyses systems.

(c) If drift is minimal, simple methods of analyzing the data and calculating the residual oil saturation may be possible.

In general, the present process can be utilized in substantially any of the reservoir situations or fluid saturation determining processes for which the prior processes were suitable.

The halo-organic acid salt used in the present process can be substantially any which is water soluble, hydrolyzes and reacts with carbonate salts to form $CO_2$ and a water soluble salt and is compatible with the fluids and solids in the reservoir and the other components of the tracer forming solution to be injected.

The carbonic acid salt suitable for use in the present process can comprise substantially any water soluble carbonate or bicarbonate containing cations which form water soluble salts with the hydrolysis product of the halocarboxylic acid salt and are compatible with the reservoir materials and other components of the injected tracer forming solution. Also solid carbonate or dolomitic salts (such as $CaCO_3$, $FeCO_3$ $MgCO_3$) which may be present in the reservoir are suitable A tracer forming solution suitable for use in this invention comprises an acid generator consisting essentially of at least one halocarboxylic acid salt dissolved in an aqueous solution which contains or will contact salt when the solution is injected into the reservoir being treated at least one acid reactive carbonate or bicarbonate. The tracer forming solution preferably contains enough substantially neutral salt and pH adjusting acid or base material to provide a composition which is at least compatible with, if not substantially similar to, the aqueous liquid present in the reservoir to be tested. The combination of the kinds and amounts of halocarboxylic and carbonic acid salts are preferably tailored with respect to the reservoir temperature to provide readily detectable amounts of $CO_2$ and hydroxycarboxylic acid anions in the respective mobile and immobile liquid phases in the reservoir. In addition, what is important is that, at least soon after entering the reservoir, the tracer forming solution contains enough carbonic acid salt to generate sufficient $CO_2$ from the acid formed by the hydrolysis of the halocarboxylic acid anions. Where the reservoir contains water soluble or insoluble carbonate components the tracer forming solution, as injected, can be substantially or even completely free of carbonic acid salt, until that solution contacts the reservoir formation and the carbonic acid salt is dissolved and/or diffused from the reservoir rocks or fluid into the tracer forming solution.

Table II lists results of testing various $CO_2$ generators at various temperatures and pH's. In each case, the solution was maintained at a pressure of 50 psig during each test. The pH of the solution was maintained substantially constant by adding portions of 0.1 mol/liter sodium bicarbonate solution to the system while the hydrolysis was proceeding. Each acid generator solution consisted of water containing 0.5 mol/liter sodium chloride and 0.05 mols/liter of the indicated halocarboxylic acid salt.

TABLE II

| Test | Acid/Base Generator | Temp. °F. | pH*2 | Half Life,*1 $t_{\frac{1}{2}}$ hours |
|---|---|---|---|---|
| 1 | 3-Chloropropionic acid | 138 | 8.0 | 43.5 |
| 2 | " | 140 | 7.0 | 16.1 |
| 3 | " | 133 | 6.2 | 27.9 |
| 4 | " | 133 | 5.5 | 30.4 |
| 5 | " | 113 | 5.5 | 114.0 |
| 6 | " | 117 | 6.2 | 95.8 |
| 7 | " | 114 | 7.0 | 130.1 |
| 8 | Monochloroacetic acid | 182 | 7.0 | 127.9 |
| 9 | " | 198 | 7.0 | 49.4 |
| 10 | Dichloroacetic acid | 197 | 7.0 | 111.8 |
| 11 | " | 221 | 7.0 | 23.0 |
| 12 | O—Chlorobenzoic acid | 212 | 7.0 | 3,113 |
| 13 | " | 212 | 6.2 | 2,543 |
| 14 | " | 204 | 8.0 | 3,906 |
| 15 | " | 251 | 8.0 | 2,335 |
| 16 | Bromoacetic acid | 167 | 5.5 | 17.3 |
| 17 | " | 166 | 7.0 | 12.5 |
| 18 | " | 143 | 7.0 | 171.4 |
| 19 | " | 156 | 6.2 | 32.6 |
| 20 | " | 140 | 6.2 | 136.9 |
| 21 | " | 124 | 6.2 | 319.2 |
| 22 | 3-Chlorobutyric acid | 125 | 6.2 | 13.2 |
| 23 | " | 99 | 6.2 | 29.2 |
| 24 | " | 102 | 6.2 | 80.0 |
| 25 | 2-Chloropropionic acid | 130 | 6.2 | 73.1 |
| 26 | " | 114 | 6.2 | 598.5 |
| 27 | (P—Bromophenoxy) | 285 | 5.5 | 665.4 |

*1This is the time, in hours, required for the acid generator to be one-half reacted to form $CO_2$ or acid. This is a convenient way to measure the speed of a reaction.

The patterns of the concentrations with amounts of fluid produced from the reservoir being tested (and/or concentrations with time, where the production rate is substantially constant) can be measured by currently known and available methods and apparatus. It is a distinctive advantage of the present process that known and available relatively simple procedures, such as titrometric and/or thermometric analyses, can be utilized to measure the chromatographic separation between the $CO_2$ partitioned between the phases and the acid anions dissolved substantially completely in the mobile phase of the reservoir fluid.

In the present system, pH is much less important in controlling the rate of hydrolysis as it changes only by about a factor of 3 per 1 unit change in pH (see Table II, tests 1 and 2). Also, the reaction speeds up with drop in pH (i.e., the rate is proportional to H ions). This means that the hydrolysis rate of the $CO_2$ generators will speed up as the acid is generated and give a much more reliable amount of $CO_2$ from test to test. Also, if the $CO_2$ generator is completely spent in the reservoir, no difficulty will be caused because the water tracer depends on the acid anion associated with the $CO_2$-acid generator.

What is claimed is:

1. In a process in which a reactant-containing aqueous solution is injected into a subterranean reservoir to form tracers having different partition coefficients with mobile water and immobile oil phases of the fluid in the reservoir and measurements are made of the amounts by which the tracers are chromatographically separated in order, to determine the relative concentrations of those phases, an improvement which comprises:

injecting as said tracer-forming solution an aqueous liquid which, before or soon after entering the reservoir, contains dissolved salts of at least one halocarboxylic acid in contact with at least one salt of carbonic acid in kinds and amounts suitable for reacting within the reservoir to form $CO_2$ and salts of water soluble acids in amounts such that measurable proportions of $CO_2$ are partitioned between mobile and immobile phases of the reservoir fluids and anions of said acids are dissolved substantially completely within the mobile phase of the reservoir fluid.

2. The process of claim 1 in which the pH of the injected fluid is adjusted to approximate that of the aqueous fluid in the reservoir being tested.

3. The process of claim 1 in which the kinds and amounts of the tracer-forming fluids are arranged to provide said amounts of said tracers within a selected relatively short time.

4. The process of claim 1 in which the injected fluids are produced by withdrawing them through the well through which they were injected.

* * * * *